United States Patent [19]

Petty, Jr.

[11] 4,086,954

[45] May 2, 1978

[54] FLASK AND PATTERN STARTER

[76] Inventor: John L. Petty, Jr., Route No. 3, Walnut Ridge, Ark. 72476

[21] Appl. No.: 696,265

[22] Filed: Nov. 1, 1976

[51] Int. Cl.[2] ..... B22D 17/22

[52] U.S. Cl. ..... 164/404; 164/344; 164/412

[58] Field of Search ..... 164/344, 401, 404, 412; 249/160, 161; 425/441, 443

[56] References Cited

U.S. PATENT DOCUMENTS 3,853,451 12/1974 Bendzick ..... 164/344 X

FOREIGN PATENT DOCUMENTS 1,812,806 12/1970 Germany ..... 164/412

*Primary Examiner*—Francis S. Husar
*Assistant Examiner*—Mark Rosenbaum

[57] ABSTRACT

A "Flask and Pattern Starter" device, for the purpose of providing a seal-breaking movement of the cope flask and for the matchplate pattern also, as a molder "squeezer molds" in a foundry operation where he is lifting a flask, and a pattern. The apparatus serves as a leverage surface for the hands of the molder as he separates the pattern from cope and drag flasks in a molding operation. The device is placed over guide pins which are normally used on pattern equipment in the foundry operations.

2 Claims, 1 Drawing Figure

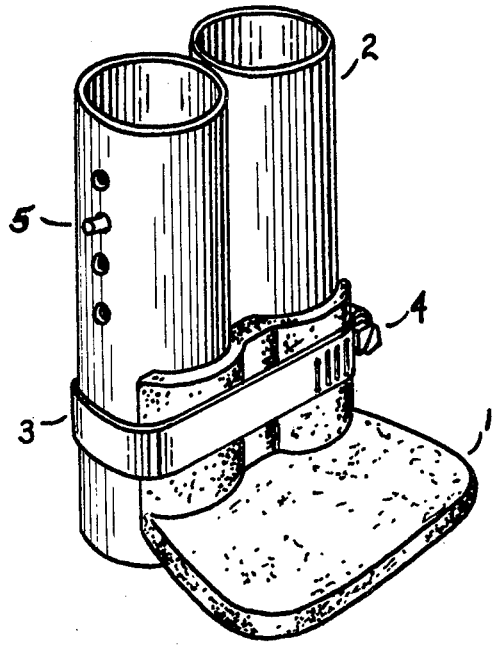
2
5
4
3
1

FLASK AND PATTERN STARTER

FIELD OF THE INVENTION

Some devices have been developed to assist the molder with flask removal before, in the form of ropes or lines and weights of some sort, but to my knowledge, the "Flask and Pattern Starter" which I have invented is new and does not exist anywhere else in the world.

BRIEF DESCRIPTION OF THE DRAWING

The FIGURE shows my Flask and Pattern Starter.

DETAILED DESCRIPTION OF THE DRAWING

As shown by the drawing, the handle 1 is a casting, and is held tightly onto two tubes 2 by an adjustable band 3 with screw adjustement 4. (A single tube type being used for a single pin flask setup) Appropriate size tubes are used for various sizes of guide pins, and height of the device of the pins is "set" by insertion of spacer pin 5 at one of several levels.

Referring to drawing, two tubes 2 as shown are slid down over guide pins which are normally found on flask and pattern equipment. A spacer pin 5 serves to determine the height of the apparatus on the guide pins. The tubes are secured together by a band 3 and also are held tightly to the cast piece 1 so that the whole works as a unit placed in position for the molder to place one hand on the flat surface of the casting 1 and extend the fingers toward a projection point on the equipment, pulling upward with the leverage point provided by said apparatus. The cope flask, or the pattern itself may be removed in this manner.

With the "Flask and Pattern Starter", initial effort in molding operation is that of squeezing the hands instead of bending the back.

I claim as my invention:

1. A device for facilitating a bond breaking movement of a cope flask from a match-plate pattern located on a drag flask, comprising a handle for use as a handrest and leverage surface for a molder's hands, an adjustable band, and at least one tube for locating the device on at least one guide pin on such a drag flask, said adjustable band removably connecting said handle to said at least one tube, said handle extending substantially radially outwardly of said at least one tube.

2. The device as claimed in claim 1 wherein said at least one tube has a plurality of diametrical holes, axially spaced, and pin means selectively and removably mounted in said holes.

* * * * *